US008272579B2

(12) United States Patent
King et al.

(10) Patent No.: US 8,272,579 B2
(45) **Date of Patent: *Sep. 25, 2012**

(54) MECHANICALLY INTEGRATED AND CLOSELY COUPLED PRINT HEAD AND MIST SOURCE

(75) Inventors: Bruce H. King, Albuquerque, NM (US); Gregory J. Marquez, Alburquerque, NM (US); Michael J. Renn, Hudson, WI (US)

(73) Assignee: Optomec, Inc., Albuquerque, NM (US)

( * ) Notice: Subject to any disclaimer, the term of this patent is extended or adjusted under 35 U.S.C. 154(b) by 967 days.

This patent is subject to a terminal disclaimer.

(21) Appl. No.: 12/203,037

(22) Filed: Sep. 2, 2008

(65) Prior Publication Data

US 2009/0061089 A1 Mar. 5, 2009

Related U.S. Application Data

(60) Provisional application No. 60/969,068, filed on Aug. 30, 2007.

(51) Int. Cl.
*B05B 1/28* (2006.01)

(52) U.S. Cl. ..... 239/290; 239/227

(58) Field of Classification Search ..... 239/127, 239/290, 291, 297, 398, 417.3, 417.5, 419.5, 239/422, 581.2, 451, 456, 227, 225.1
See application file for complete search history.

(56) References Cited

U.S. PATENT DOCUMENTS

| | | | | |
|---|---|---|---|---|
| 3,474,971 | A | | 10/1969 | Goodrich |
| 3,590,477 | A | | 7/1971 | Cheroff et al. |
| 3,642,202 | A | | 2/1972 | Angelo |
| 3,715,785 | A | | 2/1973 | Brown et al. |
| 3,808,432 | A | | 4/1974 | Ashkin |
| 3,808,550 | A | | 4/1974 | Ashkin |
| 3,816,025 | A | * | 6/1974 | O'Neill ..... 417/9 |
| 3,846,661 | A | | 11/1974 | Brown et al. |
| 3,854,321 | A | | 12/1974 | Dahneke |
| 3,901,798 | A | | 8/1975 | Peterson |
| 3,959,798 | A | | 5/1976 | Hochberg et al. |
| 3,974,769 | A | | 8/1976 | Hochberg et al. |
| 3,982,251 | A | | 9/1976 | Hochberg |
| 4,004,733 | A | | 1/1977 | Law |
| 4,016,417 | A | | 4/1977 | Benton |
| 4,019,188 | A | | 4/1977 | Hochberg |
| 4,034,025 | A | | 7/1977 | Martner |

(Continued)

FOREIGN PATENT DOCUMENTS

DE 198 41 401 4/2000

(Continued)

OTHER PUBLICATIONS

*Webster's Ninth New Collegiate Dictionary* Merriam-Webster, Inc., Springifled, MA. USA 1990 , 744.

(Continued)

*Primary Examiner* — Davis Hwu
(74) *Attorney, Agent, or Firm* — Philip D. Askenazy; Peacock Myers, P.C.

(57) ABSTRACT

A deposition apparatus comprising one or more atomizers structurally integrated with a deposition head. The entire head may be replaceable, and prefilled with material. The deposition head may comprise multiple nozzles. Also an apparatus for three dimensional materials deposition comprising a tiltable deposition head attached to a non-tiltable atomizer. Also methods and apparatuses for depositing different materials either simultaneously or sequentially.

18 Claims, 7 Drawing Sheets

U.S. PATENT DOCUMENTS

| | | | | |
|---|---|---|---|---|
| 4,046,073 | A | 9/1977 | Mitchell et al. | |
| 4,046,074 | A | 9/1977 | Hochberg et al. | |
| 4,092,535 | A | 5/1978 | Ashkin et al. | |
| 4,112,437 | A | 9/1978 | Mir et al. | |
| 4,132,894 | A | 1/1979 | Yule | |
| 4,171,096 | A | 10/1979 | Welsh et al. | |
| 4,200,669 | A | 4/1980 | Schaefer et al. | |
| 4,228,440 | A | 10/1980 | Horike et al. | |
| 4,269,868 | A | 5/1981 | Livsey | |
| 4,323,756 | A | 4/1982 | Brown et al. | |
| 4,453,803 | A | 6/1984 | Hidaka et al. | |
| 4,485,387 | A | 11/1984 | Drumheller | |
| 4,497,692 | A | 2/1985 | Gelchinski et al. | |
| 4,601,921 | A | 7/1986 | Lee | |
| 4,605,574 | A | 8/1986 | Yonehara et al. | |
| 4,670,135 | A | 6/1987 | Marple et al. | |
| 4,689,052 | A | 8/1987 | Ogren et al. | |
| 4,825,299 | A | 4/1989 | Okada et al. | |
| 4,826,583 | A | 5/1989 | Biernaux et al. | |
| 4,893,886 | A | 1/1990 | Ashkin et al. | |
| 4,904,621 | A | 2/1990 | Loewenstein et al. | |
| 4,911,365 | A | 3/1990 | Thiel et al. | |
| 4,947,463 | A | 8/1990 | Matsuda et al. | |
| 4,971,251 | A | 11/1990 | Dobrick et al. | |
| 4,997,809 | A | 3/1991 | Gupta | |
| 5,032,850 | A | 7/1991 | Andeen et al. | |
| 5,043,548 | A | 8/1991 | Whitney et al. | |
| 5,064,685 | A | 11/1991 | Kestenbaum et al. | |
| 5,164,535 | A | 11/1992 | Leasure | |
| 5,170,890 | A | 12/1992 | Wilson et al. | |
| 5,176,744 | A | 1/1993 | Muller | |
| 5,182,430 | A | 1/1993 | Lagain | |
| 5,194,297 | A | 3/1993 | Scheer et al. | |
| 5,208,431 | A | 5/1993 | Uchiyama et al. | |
| 5,250,383 | A | 10/1993 | Naruse | |
| 5,254,832 | A | 10/1993 | Gartner et al. | |
| 5,270,542 | A | 12/1993 | McMurry et al. | |
| 5,292,418 | A | 3/1994 | Morita et al. | |
| 5,322,221 | A | 6/1994 | Anderson | |
| 5,335,000 | A | 8/1994 | Stevens | |
| 5,344,676 | A | 9/1994 | Kim et al. | |
| 5,366,559 | A | 11/1994 | Periasamy | |
| 5,378,505 | A | 1/1995 | Kubota et al. | |
| 5,378,508 | A | 1/1995 | Castro et al. | |
| 5,403,617 | A | 4/1995 | Haaland | |
| 5,425,802 | A | 6/1995 | Burton et al. | |
| 5,449,536 | A | 9/1995 | Funkhouser | |
| 5,486,676 | A | 1/1996 | Aleshin | |
| 5,495,105 | A | 2/1996 | Nishimura et al. | |
| 5,512,745 | A | 4/1996 | Finer et al. | |
| 5,609,921 | A | 3/1997 | Gitzhofer et al. | |
| 5,612,099 | A | 3/1997 | Thaler | |
| 5,614,252 | A | 3/1997 | McMillan et al. | |
| 5,648,127 | A | 7/1997 | Turchan et al. | |
| 5,676,719 | A | 10/1997 | Stavropoulos et al. | |
| 5,732,885 | A | 3/1998 | Huffman | |
| 5,733,609 | A | 3/1998 | Wang | |
| 5,736,195 | A | 4/1998 | Haaland | |
| 5,742,050 | A | 4/1998 | Amirav et al. | |
| 5,770,272 | A | 6/1998 | Biemann et al. | |
| 5,772,106 | A | 6/1998 | Ayers et al. | |
| 5,814,152 | A | 9/1998 | Thaler | |
| 5,844,192 | A | 12/1998 | Wright et al. | |
| 5,854,311 | A | 12/1998 | Richart | |
| 5,861,136 | A | 1/1999 | Glicksman et al. | |
| 5,882,722 | A | 3/1999 | Kydd | |
| 5,894,403 | A | 4/1999 | Shah et al. | |
| 5,940,099 | A | 8/1999 | Karlinski | |
| 5,958,268 | A | 9/1999 | Engelsberg et al. | |
| 5,965,212 | A | 10/1999 | Dobson et al. | |
| 5,980,998 | A | 11/1999 | Sharma et al. | |
| 5,993,549 | A | 11/1999 | Kindler et al. | |
| 5,997,956 | A | 12/1999 | Hunt et al. | |
| 6,007,631 | A | 12/1999 | Prentice et al. | |
| 6,015,083 | A | 1/2000 | Hayes et al. | |
| 6,021,776 | A * | 2/2000 | Allred et al. | 128/200.21 |
| 6,025,037 | A | 2/2000 | Wadman et al. | |
| 6,036,889 | A | 3/2000 | Kydd | |
| 6,110,144 | A | 8/2000 | Choh et al. | |
| 6,116,718 | A | 9/2000 | Peeters et al. | |
| 6,136,442 | A | 10/2000 | Wong | |
| 6,151,435 | A | 11/2000 | Pilloff | |
| 6,159,749 | A | 12/2000 | Liu | |
| 6,182,688 | B1 | 2/2001 | Fabre | |
| 6,197,366 | B1 | 3/2001 | Takamatsu | |
| 6,251,488 | B1 | 6/2001 | Miller et al. | |
| 6,258,733 | B1 | 7/2001 | Solayappan et al. | |
| 6,265,050 | B1 | 7/2001 | Wong et al. | |
| 6,267,301 | B1 | 7/2001 | Haruch | |
| 6,290,342 | B1 | 9/2001 | Vo et al. | |
| 6,291,088 | B1 | 9/2001 | Wong | |
| 6,293,659 | B1 | 9/2001 | Floyd et al. | |
| 6,340,216 | B1 | 1/2002 | Peeters et al. | |
| 6,348,687 | B1 | 2/2002 | Brockmann et al. | |
| 6,349,668 | B1 * | 2/2002 | Sun et al. | 118/723 R |
| 6,379,745 | B1 | 4/2002 | Kydd et al. | |
| 6,384,365 | B1 | 5/2002 | Seth et al. | |
| 6,390,115 | B1 | 5/2002 | Rohwer et al. | |
| 6,391,494 | B2 | 5/2002 | Reitz et al. | |
| 6,406,137 | B1 | 6/2002 | Okazaki et al. | |
| 6,416,156 | B1 | 7/2002 | Noolandi et al. | |
| 6,416,157 | B1 | 7/2002 | Peeters et al. | |
| 6,416,158 | B1 | 7/2002 | Floyd et al. | |
| 6,416,159 | B1 | 7/2002 | Floyd et al. | |
| 6,454,384 | B1 | 9/2002 | Peeters et al. | |
| 6,467,862 | B1 | 10/2002 | Peeters et al. | |
| 6,471,327 | B2 | 10/2002 | Jagannathan et al. | |
| 6,481,074 | B1 | 11/2002 | Karlinski | |
| 6,503,831 | B2 | 1/2003 | Speakman | |
| 6,513,736 | B1 | 2/2003 | Skeath et al. | |
| 6,521,297 | B2 | 2/2003 | McDougall et al. | |
| 6,537,501 | B1 | 3/2003 | Holl et al. | |
| 6,544,599 | B1 | 4/2003 | Brown et al. | |
| 6,548,122 | B1 | 4/2003 | Sharma et al. | |
| 6,573,491 | B1 | 6/2003 | Marchitto et al. | |
| 6,607,597 | B2 | 8/2003 | Sun et al. | |
| 6,636,676 | B1 | 10/2003 | Renn | |
| 6,646,253 | B1 | 11/2003 | Rohwer et al. | |
| 6,772,649 | B2 | 8/2004 | Zimmermann et al. | |
| 6,780,377 | B2 | 8/2004 | Hall et al. | |
| 6,811,805 | B2 | 11/2004 | Gilliard et al. | |
| 6,823,124 | B1 | 11/2004 | Renn et al. | |
| 6,890,624 | B1 | 5/2005 | Kambe et al. | |
| 6,998,785 | B1 | 2/2006 | Silfvast et al. | |
| 7,045,015 | B2 | 5/2006 | Renn et al. | |
| 7,108,894 | B2 * | 9/2006 | Renn | 427/596 |
| 7,270,844 | B2 * | 9/2007 | Renn | 427/58 |
| 7,294,366 | B2 | 11/2007 | Renn et al. | |
| 7,485,345 | B2 | 2/2009 | Renn et al. | |
| 7,658,163 | B2 * | 2/2010 | Renn et al. | 118/308 |
| 7,674,671 | B2 | 3/2010 | Renn et al. | |
| 2001/0046551 | A1 | 11/2001 | Falck et al. | |
| 2002/0012743 | A1 | 1/2002 | Sampath et al. | |
| 2002/0063117 | A1 | 5/2002 | Church et al. | |
| 2002/0096647 | A1 | 7/2002 | Moors et al. | |
| 2002/0100416 | A1 | 8/2002 | Sun et al. | |
| 2002/0132051 | A1 | 9/2002 | Choy | |
| 2002/0162974 | A1 | 11/2002 | Orsini et al. | |
| 2003/0003241 | A1 | 1/2003 | Suzuki et al. | |
| 2003/0020768 | A1 | 1/2003 | Renn | |
| 2003/0048314 | A1 | 3/2003 | Renn | |
| 2003/0108511 | A1 | 6/2003 | Sawhney | |
| 2003/0117691 | A1 | 6/2003 | Bi et al. | |
| 2003/0138967 | A1 | 7/2003 | Hall et al. | |
| 2003/0175411 | A1 | 9/2003 | Kodas et al. | |
| 2003/0180451 | A1 | 9/2003 | Kodas et al. | |
| 2003/0202032 | A1 | 10/2003 | Moffat et al. | |
| 2003/0219923 | A1 | 11/2003 | Nathan et al. | |
| 2003/0228124 | A1 | 12/2003 | Renn et al. | |
| 2004/0029706 | A1 | 2/2004 | Barrera et al. | |
| 2004/0151978 | A1 | 8/2004 | Huang | |
| 2004/0179808 | A1 | 9/2004 | Renn | |
| 2004/0197493 | A1 | 10/2004 | Renn et al. | |
| 2004/0247782 | A1 | 12/2004 | Hampden-Smith et al. | |
| 2005/0002818 | A1 | 1/2005 | Ichikawa | |
| 2005/0129383 | A1 | 6/2005 | Renn et al. | |
| 2005/0147749 | A1 | 7/2005 | Liu et al. | |

| | | | |
|---|---|---|---|
| 2005/0156991 | A1 | 7/2005 | Renn |
| 2005/0163917 | A1 | 7/2005 | Renn |
| 2005/0184328 | A1 | 8/2005 | Uchiyama et al. |
| 2005/0205696 | A1 | 9/2005 | Saito et al. |
| 2006/0008590 | A1 | 1/2006 | King et al. |
| 2006/0057014 | A1 | 3/2006 | Oda et al. |
| 2006/0163570 | A1 | 7/2006 | Renn et al. |
| 2006/0172073 | A1 | 8/2006 | Groza et al. |
| 2006/0175431 | A1 | 8/2006 | Renn et al. |
| 2006/0233953 | A1 | 10/2006 | Renn et al. |
| 2006/0280866 | A1 | 12/2006 | Marquez et al. |
| 2007/0019028 | A1 | 1/2007 | Renn |
| 2007/0154634 | A1 | 7/2007 | Renn |
| 2007/0181060 | A1 | 8/2007 | Renn et al. |
| 2008/0013299 | A1 | 1/2008 | Renn |
| 2009/0061077 | A1 | 3/2009 | King et al. |
| 2009/0061089 | A1 | 3/2009 | King et al. |
| 2009/0090298 | A1 | 4/2009 | King et al. |
| 2009/0114151 | A1 | 5/2009 | Renn et al. |
| 2010/0173088 | A1 | 7/2010 | King |
| 2010/0192847 | A1 | 8/2010 | Renn et al. |
| 2010/0255209 | A1 | 10/2010 | Renn et al. |
| 2011/0129615 | A1 | 6/2011 | Renn et al. |

FOREIGN PATENT DOCUMENTS

| | | | |
|---|---|---|---|
| EP | 0 331 022 | A2 | 9/1989 |
| EP | 0 444 550 | A2 | 9/1991 |
| EP | 0470911 | | 7/1994 |
| EP | 1 258 293 | | 11/2002 |
| JP | 2001-507449 | | 6/2001 |
| JP | 2007-507114 | | 3/2007 |
| KR | 10-2007-0008614 | | 1/2007 |
| KR | 10-2007-0008621 | | 1/2007 |
| WO | WO 00/23825 | | 4/2000 |
| WO | WO 00/69235 | | 11/2000 |
| WO | WO 01/83101 | A1 | 11/2001 |
| WO | WO 2006/041657 | A2 | 4/2006 |
| WO | WO 2006/065978 | A2 | 6/2006 |

OTHER PUBLICATIONS

Ashkin, A , "Acceleration and Trapping of Particles by Radiation Pressure", *Physical Review Letters* Jan. 26, 1970 , 156-159.

Ashkin, A. , "Optical trapping and manipulation of single cells using infrared laser beams", *Nature* Dec. 1987 , 769-771.

Dykhuizen, R. C. , "Impact of High Velocity Cold Spray Particles", May 13, 2000 , 1-18.

Fernandez De La Mora, J. et al., "Aerodynamic focusing of particles in a carrier gas", *J. Fluid Mech.* vol. 195, printed in Great Britain 1988, 1-21.

King, Bruce et al., "M3D TM Technology: Maskless Mesoscale TM Materials Deposition", *Optomec pamphlet* 2001.

Lewandowski, H. J. et al., "Laser Guiding of Microscopic Particles in Hollow Optical Fibers", *Announcer 27, Summer Meeting—Invited and Contributed Abstracts* Jul. 1997 , 89.

Marple, V. A. et al., "Inertial, Gravitational, Centrifugal, and Thermal Collection Techniques", *Aerosol Measurement: Principles, Techniques and Applications* 2001 , 229-260.

Miller, Doyle et al., "Maskless Mesoscale Materials Deposition", *HDI* vol. 4, No. 9 Sep. 2001 , 1-3.

Odde, D. J. et al., "Laser-Based Guidance of Cells Through Hollow Optical Fibers", *The American Society for Cell Biology Thirty-Seventh Annual Meeting* Dec. 17, 1997.

Odde, D. J. et al., "Laser-guided direct writing for applications in biotechnology", *Trends in Biotechnology* Oct. 1999 , 385-389.

Rao, N. P. et al., "Aerodynamic Focusing of Particles in Viscous Jets", *J. Aerosol Sci.* vol. 24, No. 7, Pergamon Press, Ltd., Great Britain 1993 , 879-892.

Renn, M. J. et al., "Evanescent-wave guiding of atoms in hollow optical fibers", *Physical Review A* Feb. 1996 , R648-R651.

Renn, Michael J. et al., "Flow- and Laser-Guided Direct Write of Electronic and Biological Components", *Direct-Write Technologies for Rapid Prototyping Applications* Academic Press 2002 , 475-492.

Renn, M. J. et al., "Laser-Guidance and Trapping of Mesoscale Particles in Hollow-Core Optical Fibers", *Physical Review Letters* Feb. 15, 1999 , 1574-1577.

Renn, M. J. et al., "Laser-Guided Atoms in Hollow-Core Optical Fibers", *Physical Review Letters* Oct. 30, 1995 , 3253-3256.

Renn, M. J. et al., "Optical-dipole-force fiber guiding and heating of atoms", *Physical Review A* May 1997 , 3684-3696.

Renn, M. J. et al., "Particle Manipulation and Surface Patterning by Laser Guidance", *Submitted to EIPBN '98 Session AM4* 1998.

Renn, M. J. et al., "Particle manipulation and surface patterning by laser guidance", *Journal of Vacuum Science & Technology B* Nov./Dec. 1998 , 3859-3863.

Sobeck, et al., *Technical Digest: 1994 Solid-State Sensor and Actuator Workshop* 1994 , 647.

TSI Incorporated, "How a Virtual Impactor Works", www.tsi.com. Sep. 21, 2001.

Vanheusden, K. et al., "Direct Printing of Interconnect Materials for Organic Electronics", *IMAPS ATW, Printing an Intelligent Future* Mar. 8-10, 2002 , 1-5.

Zhang, Xuefeng et al., "A Numerical Characterization of Particle Beam Collimation by an Aerodynamic Lens-Nozzle System: Part I. An Individual Lens or Nozzle", *Aerosol Science and Technology* vol. 36, Taylor and Francis 2002 , 617-631.

* cited by examiner

MECHANICALLY INTEGRATED AND CLOSELY COUPLED PRINT HEAD AND MIST SOURCE

CROSS-REFERENCE TO RELATED APPLICATIONS

This application claims the benefit of the filing of U.S. Provisional Patent Application Ser. No. 60/969,068, entitled "Mechanically Integrated and Closely Coupled Print Head and Mist Source", filed on Aug. 30, 2007, the specification of which is incorporated herein by reference.

BACKGROUND OF THE INVENTION

Field of the Invention (Technical Field)

The present invention is an apparatus comprising an atomizer located within or adjacent to a deposition head used to directly deposit material onto planar or non-planar targets.

BRIEF SUMMARY OF THE INVENTION

The present invention is a deposition head for depositing a material, the deposition head comprising one or more carrier gas inlets, one or more atomizers, an aerosol manifold structurally integrated with the one or more atomizers, one or more aerosol delivery conduits in fluid connection with the aerosol manifold, a sheath gas inlet and one or more material deposition outlets. The deposition head preferably further comprises a virtual impactor and an exhaust gas outlet, the virtual impactor disposed between at least one of the one or more atomizers and the aerosol manifold. The deposition head preferably further comprises a reservoir of material, and optionally a drain for transporting unused material from the aerosol manifold back into the reservoir. The deposition head optionally further comprises an external reservoir of material useful for a purpose selected from the group consisting of enabling a longer period of operation without refilling, maintaining the material at a desired temperature, maintaining the material at a desired viscosity, maintaining the material at a desired composition, and preventing agglomeration of particulates. The deposition head preferably further comprises a sheath gas manifold concentrically surrounding at least a middle portion of the one or more aerosol delivery conduits. The deposition head optionally further comprises a sheath gas chamber surrounding a portion of each aerosol delivery conduit comprising a conduit outlet, the aerosol delivery conduit preferably being sufficiently long so the sheath gas flow is substantially parallel to the aerosol flow before the flows combine at or near an outlet of the sheath gas chamber after the aerosol flow exits the conduit outlet. The deposition head is optionally replaceable and comprises a material reservoir prefilled with material before installation. Such a deposition head is optionally disposable or refillable. Each of the one or more atomizers optionally atomizes different materials, which preferably do not mix and/or react until just before or during deposition. The ratio of the different materials to be deposited is preferably controllable. The atomizers are optionally operated simultaneously, or at least two of the atomizers are optionally operated at different times.

The present invention is also an apparatus for three-dimensional material deposition, the apparatus comprising a deposition head and an atomizer, wherein the deposition head and atomizer travel together in three linear dimensions, and wherein the deposition head is tiltable but the atomizer is not tiltable. The apparatus is preferably useful for depositing the material on the exterior, interior, and/or underside of a structure and is preferably configured so that the deposition head is extendible into a narrow passage.

The present invention is also a method for depositing materials comprising the steps of atomizing a first material to form a first aerosol, atomizing a second material to form a second aerosol, combining the first aerosol and second aerosol, surrounding the combined aerosols with an annular flow of a sheath gas, focusing the combined aerosols, and depositing the aerosols. The atomizing steps are optionally performed simultaneously or sequentially. The method optionally further comprises the step of varying the amount of material in at least one of the aerosols. The atomizing steps optionally comprise using atomizers of a different design. The method optionally further comprises the step of depositing a composite structure.

An advantage of the present invention is improved deposition due to reduced droplet evaporation and reduced overspray.

Another advantage to the present invention is a reduction in the delay between the initiation of gas flow and deposition of material onto a target.

Objects, other advantages and novel features, and further scope of applicability of the present invention will be set forth in part in the detailed description to follow, taken in conjunction with the accompanying drawing, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
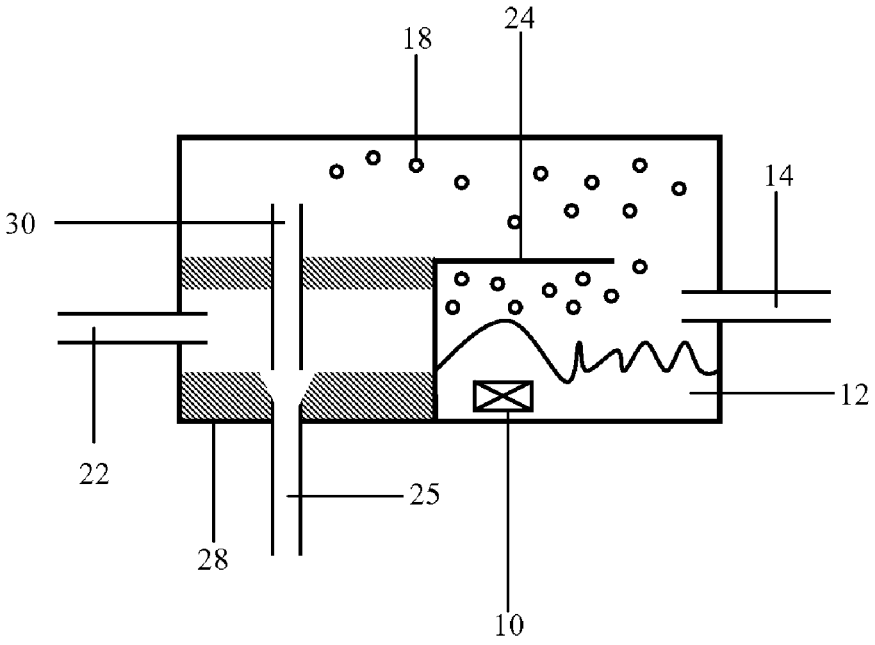
FIG. 1 is a schematic of an apparatus of the present invention for gradient material fabrication.

The present invention generally relates to apparatuses and methods for high-resolution, maskless deposition of liquids, solutions, and liquid-particle suspensions using aerodynamic focusing. In one embodiment, an aerosol stream is focused and deposited onto a planar or non-planar target, forming a pattern that is thermally or photochemically processed to achieve physical, optical, and/or electrical properties near that of the corresponding bulk material. The process is called $M^3D$® (Maskless Mesoscale Material Deposition) technology, and is used to deposit, preferably directly and without the use of masks, aerosolized materials with linewidths that are orders of magnitude smaller than lines deposited with conventional thick film processes, even smaller than one micron.

The $M^3D$® apparatus preferably comprises an aerosol jet deposition head to form an annularly propagating jet composed of an outer sheath flow and an inner aerosol-laden carrier flow. In the annular aerosol jetting process, the aerosol stream typically enters the deposition head, preferably either directly after the aerosolization process or after passing through a heater assembly, and is directed along the axis of the device towards the deposition head orifice. The mass throughput is preferably controlled by an aerosol carrier gas mass flow controller. Inside the deposition head, the aerosol stream is preferably initially collimated by passing through an orifice, typically millimeter-sized. The emergent particle stream is then preferably combined with an annular sheath gas, which functions to eliminate clogging of the nozzle and to focus the aerosol stream. The carrier gas and the sheath gas most commonly comprise compressed air or an inert gas, where one or both may contain a modified solvent vapor content. For example, when the aerosol is formed from an aqueous solution, water vapor may be added to the carrier gas or the sheath gas to prevent droplet evaporation.

The sheath gas preferably enters through a sheath air inlet below the aerosol inlet and forms an annular flow with the aerosol stream. As with the aerosol carrier gas, the sheath gas flowrate is preferably controlled by a mass flow controller. The combined streams exit the nozzle at a high velocity (~50 m/s) through an orifice directed at a target, and subsequently impinge upon it. This annular flow focuses the aerosol stream onto the target and allows for deposition of features with dimensions smaller than approximately 1 micron. Patterns are formed by moving the deposition head relative to the target.

Atomizer Located Adjacent to the Deposition Head

The atomizer is typically connected to the deposition head through the mist delivery means, but is not mechanically coupled to the deposition head. In one embodiment of the present invention, the atomizer and deposition head are fully integrated, sharing common structural elements.

As used throughout the specification and claims, the term "atomizer" means atomizer, nebulizer, transducer, plunger, or any other device, activated in any way including but not limited to pneumatically, ultrasonically, mechanically, or via a spray process, which is used to form smaller droplets or particles from a liquid or other material, or condense particles from a vapor, typically for suspension into an aerosol.

If the atomizer is adjacent to or integrated with the deposition head, the length of tubing required to transport the mist between the atomizer and the head is reduced or eliminated. Correspondingly, the transit time of mist in the tube is substantially reduced, minimizing solvent loss from the droplets during transport. This in turn reduces overspray and allows the use of more volatile liquids than could ordinarily be used. Further, particle losses inside the delivery tube are minimized or eliminated, improving the overall efficiency of the deposition system and reducing the incidence of clogging. The response time of the system is also significantly improved.

Further advantages relate to the use of the closely coupled head in constructing systems for manufacturing. For small substrates, automation is simplified by fixing the atomizer and deposition head and moving the substrate. In this case there are many placement options for the atomizer relative to the deposition head. However, for large substrates, such as those encountered in the manufacturing of flat panel displays, the situation is reversed and it is simpler to move the deposition head. In this case the placement options for the atomizer are more limited. Long lengths of tubing are typically required to deliver mist from a stationary atomizer to a head mounted on a moving gantry. Mist losses due to coalescence can be severe and solvent loss due to the long residence time can dry the mist to the point where it is no longer usable.

Another advantage arises in the construction of a cartridge-style atomizer and deposition head. In this configuration, the atomizer and deposition head are coupled in such a way that they may be installed onto and removed from the print system as a single unit. In this configuration the atomizer and head may be easily and rapidly replaced. Replacement may take place during normal maintenance or as a result of a catastrophic failure event such as a clogged nozzle. In this embodiment, the atomizer reservoir is preferably preloaded with feedstock such that the replacement unit is ready for use immediately upon installation. In a related embodiment, a cartridge-style unit allows rapid retooling of a print system. For example, a print head containing material A may quickly be exchanged for a print head containing material B. In these embodiments, the atomizer/head unit or cartridge are preferably engineered to be low cost, enabling them to be sold as consumables, which can be either disposable or refillable.

Figure 4:
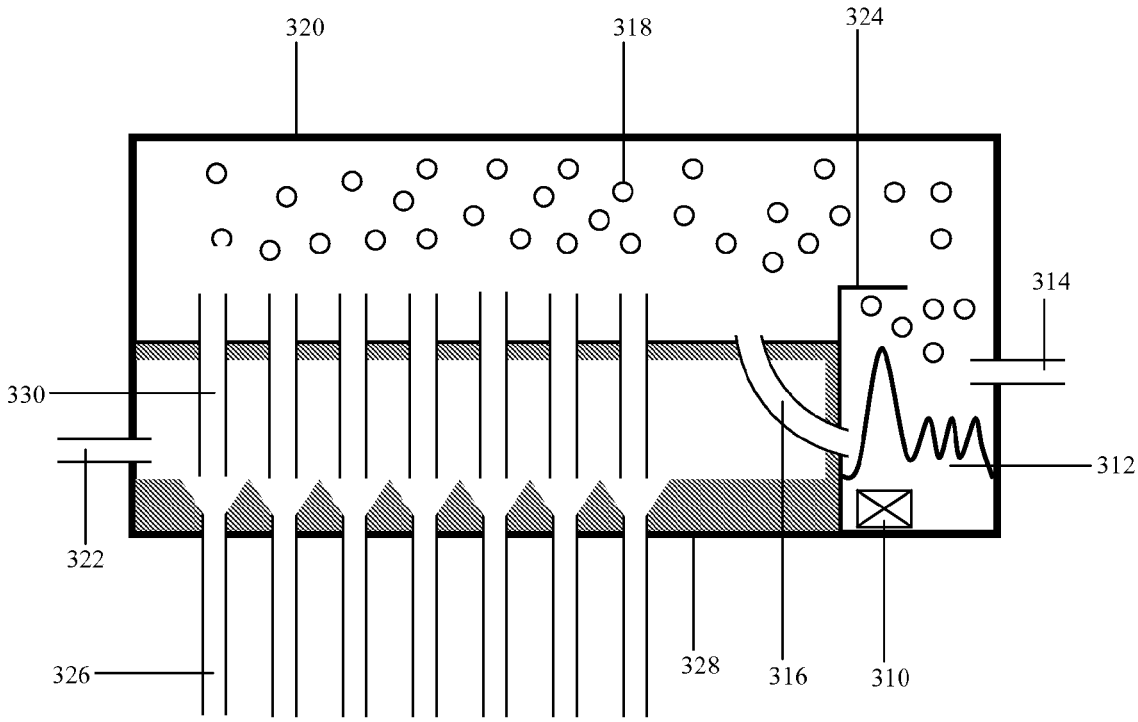
FIG. 4 is a cross-sectional schematic of a single apparatus integrating an atomizer, a deposition head, and a virtual impactor.

In one embodiment, the atomizer and deposition head are fully integrated into a single unit that shares structural elements, as shown in FIG. 4. This configuration is preferably the most compact and most closely represents the cartridge style-unit.

A virtual impactor is often used to remove the excess gas necessary for a pneumatic atomizer to operate, and thus is also integrated with the deposition head in the embodiments in which the atomizer is integrated. A heater, whose purpose is to heat the mist and drive off solvent, may also be incorporated into the apparatus. Elements necessary for maintenance of the feedstock in the atomizer, but not necessarily required for atomization, such as feedstock level control or low ink level warning, stirring and temperature controls, may optionally also be incorporated into the atomizer.

Other examples of elements that may be integrated with the apparatus generally relate to sensing and diagnostics. The motivation behind incorporating sensing elements directly into the apparatus is to improve response and accuracy. For example, pressure sensing may be incorporated into the deposition head. Pressure sensing provides important feedback about overall deposition head status; pressure that is higher than normal indicates that a nozzle has become clogged, while pressure that is lower than normal indicates that there is a leak in the system. By placing one or more pressure sensors directly in the deposition head, feedback is more rapid and more accurate. Mist sensing to determine the deposition rate of material might also be incorporated into the apparatus.

A typical aerosol jet system utilizes electronic mass flow controllers to meter gas at specific rates. Sheath gas and atomizer gas flow rates are typically different and may vary depending on the material feedstock and application. For a deposition head built for a specific purpose where adjustability is not needed, electronic mass flow controllers might be replaced by static restrictions. A static restriction of a certain size will only allow a certain amount of gas to pass through it for a given upstream pressure. By accurately controlling the upstream pressure to a predetermined level, static restrictions can be sized appropriately to replace the electronic mass flow controllers used for the sheath and atomizer gas. The mass flow controller for the virtual impactor exhaust can most easily be removed, provided that a vacuum pump is used, preferably capable of generating approximately 16 in Hg of vacuum. In this case, the restriction functions as a critical orifice. Integrating the static restrictions and other control elements in the deposition head reduces the number of gas lines that must run to the head. This is particularly useful for situations in which the head is moved rather than the substrate.

In any of the embodiments presented herein, whether or not the atomizer is integrated with the deposition head, the deposition head may comprise a single-nozzle or a multiple nozzle design, with any number of nozzles. A multi-jet array is comprised of one or more nozzles configured in any geometry.

FIG. 1 shows an embodiment of an ultrasonic atomizer integrated with an aerosol jet in a deposition head. Ink 12 is located in a reservoir adjacent to extended nozzle 25. Ultrasonic transducer 10 atomizes ink 12. Atomized ink 18 is then carried out of the reservoir by mist air or carrier gas entering through mist air inlet 14 and is directed around a shield 24 to an adjacent mist manifold, where it enters the mist delivery tube 30. Sheath gas enters sheath gas manifold 28 through sheath gas inlet 22. As the atomized ink travels through mist delivery tube 30, it is focused by the sheath air as it enters extended nozzle 25.

Figure 2:
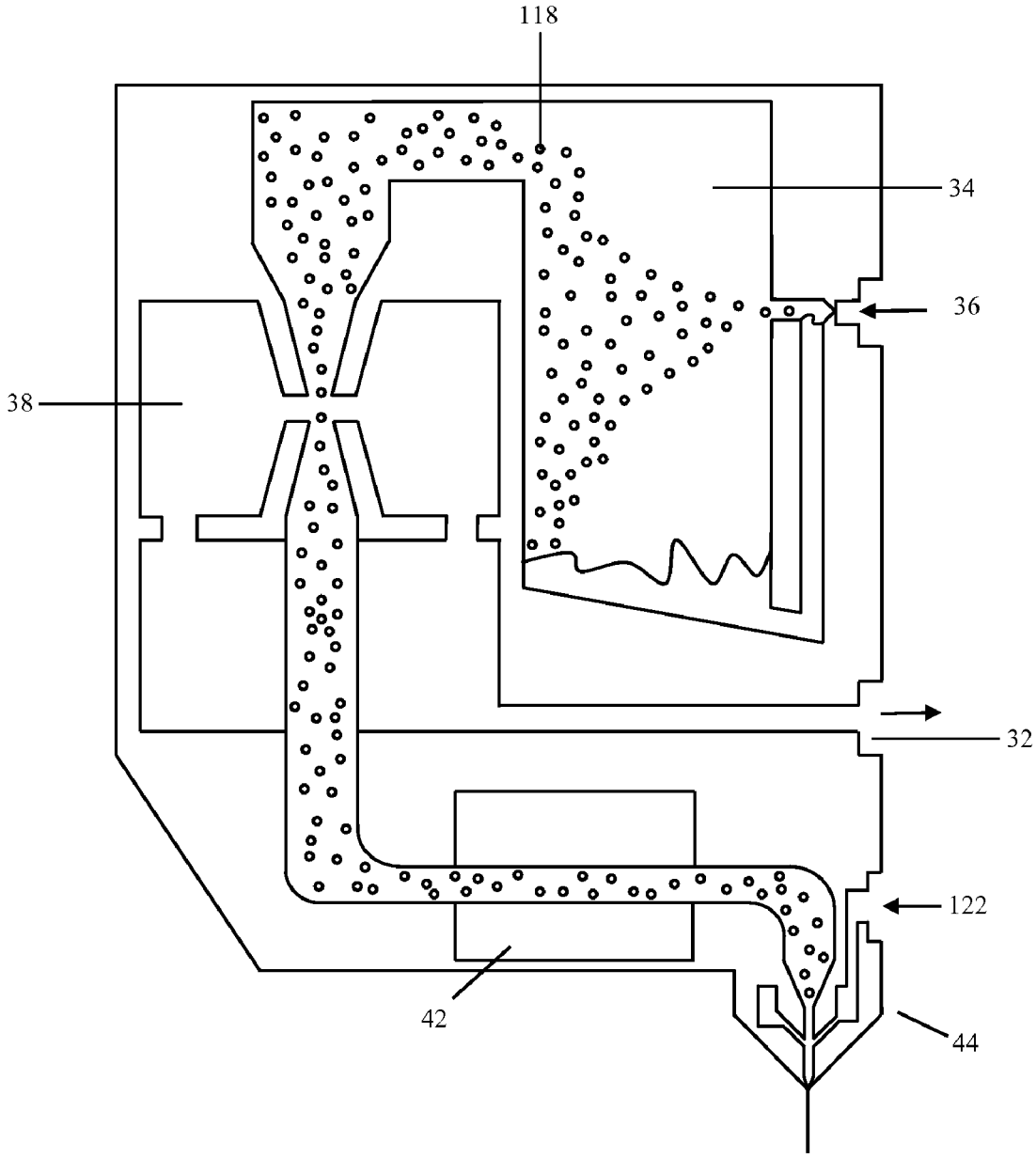
FIG. 2 is a schematic of a monolithic multi-nozzle deposition head with an atomizer.

FIG. 2 is an embodiment of an integrated pneumatic atomizing system with a single nozzle deposition head and virtual impactor. Atomization gas 36 enters ink reservoir 34 where it atomizes the ink and carries atomized ink 118 into virtual impactor 38. Atomization gas 36 is at least partially stripped and exits through the virtual impactor gas exhaust 32. Atomized ink 118 continues down through optional heater 42 and into deposition head 44. Sheath gas 122 enters the deposition head and focuses the atomized ink 118.

Figure 3:
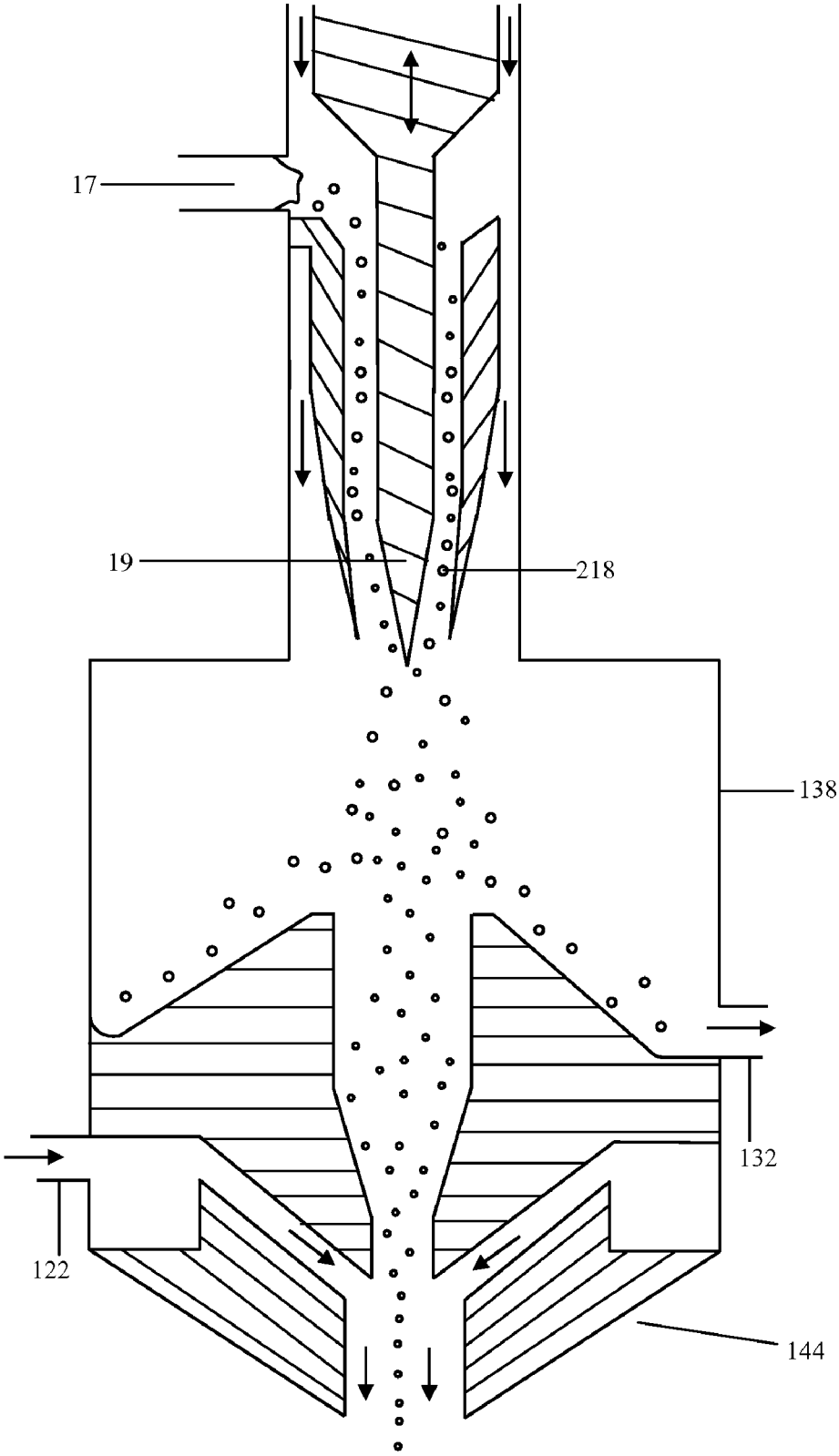
FIG. 3 is a schematic of an integrated atomizer with a single aerosol jet.

FIG. 3 is a cross-sectional schematic of an alternative embodiment of an integrated pneumatic atomizer, virtual impactor, and single nozzle deposition head. Plunger 19 that allows for adjustable flow rates is used to atomize ink entering from ink suspension inlet 17. Atomized ink 218 then travels to the adjacent virtual impactor 138. Exhaust gas exits the virtual impactor through exhaust gas outlet 132. Atomized ink 218 then travels to adjacent deposition head 144 where sheath gas 122 focuses the ink.

FIG. 4 shows an embodiment of a monolithic multi-nozzle aerosol jet deposition head with an integrated ultrasonic atomizer. Ink 312 is located in a reservoir preferably adjacent to nozzle array 326. Ultrasonic transducer 310 atomizes the ink. Atomized ink 318 is then carried out of the reservoir by mist air entering through the mist air inlet 314 and is directed around shield 324 to adjacent aerosol manifold 320, where it enters individual aerosol delivery tubes 330. Atomized ink 318 that does not enter into any of mist delivery tubes 330 is preferably recycled through drain tube 316 that empties back into the adjacent ink reservoir. Sheath gas enters sheath gas manifold 328 through sheath gas inlet 322. As atomized ink 318 travels through mist delivery tubes 330, it is focused by the sheath gas as it enters the nozzle array 326.

Figure 5:
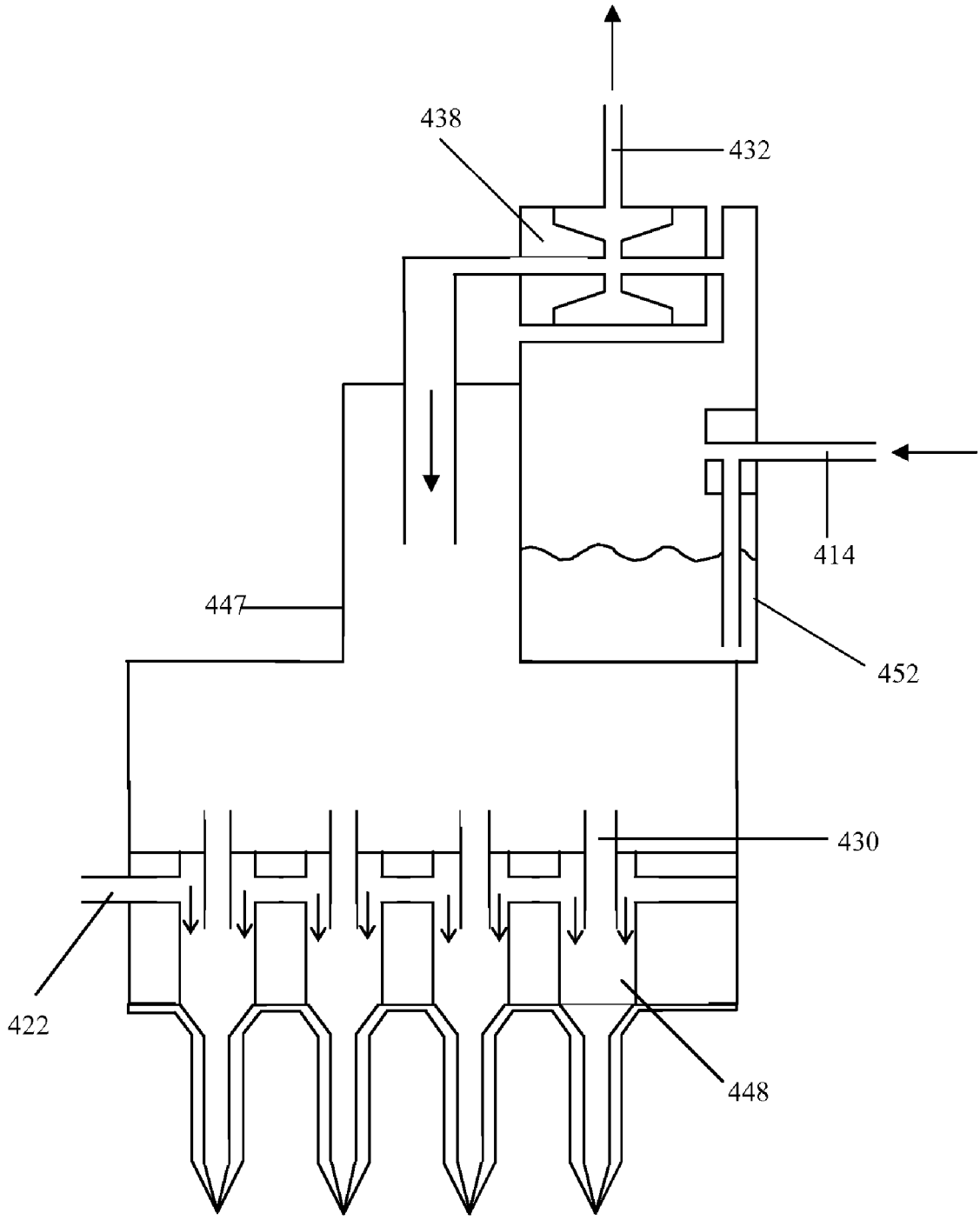
FIG. 5 is a schematic of an alternative embodiment of an integrated atomizing system with a deposition head and virtual impactor.

FIG. 5 is an embodiment of a multi-nozzle integrated pneumatic atomizing system with a deposition head that uses a manifold and a flow reduction device. Mist air enters the integrated system through mist air inlet 414 into pneumatic atomizer 452. The atomized material, which is entrained in the mist air to form an aerosol, then travels to adjacent virtual impactor 438. Exhaust gas exits the virtual impactor through exhaust gas outlet 432. The aerosol then travels to manifold inlet 447 and enters one or more sheath gas chambers 448 through one or more mist delivery tubes 430. Sheath gas enters the deposition head through gas inlet port 422, which is optionally oriented perpendicularly to mist delivery tubes 430, and combines with the aerosol flow at the bottom of mist delivery tubes 430. Mist delivery tubes 430 extend partially or fully to the bottom of sheath gas chambers 448, preferably forming a straight geometry. The length of sheath gas chambers 448 is preferably sufficiently long to ensure that the flow of the sheath gas is substantially parallel to the aerosol flow before the two combine, thereby generating a preferably cylindrically symmetric sheath gas pressure distribution. The sheath gas is then combined with the aerosol at or near the bottom of sheath gas chambers 448. Advantages to maintaining this straight region for combining the aerosol carrier gas with the sheath gas is that the sheath flow is fully developed and more evenly distributed around mist tubes 430 prior to combining with the mist, thus minimizing turbulence during the combining process, minimizing the sheath/mist mixing, reducing overspray, and resulting in tighter focusing. Further, "cross talk" between the nozzles in the array is minimized due to the individual sheath gas chambers 448.

The manifold may optionally be remotely located, or located on or within the deposition head. In either configuration, the manifold can be fed by one or more atomizers. In the pictured configuration, a single flow reduction device (virtual impactor) is used for a multi-jet array deposition head. In the event that a single stage of flow reduction is insufficient to remove enough excess carrier gas, multiple stages of reduction may be employed.

Multiple Atomizers

The apparatus may comprise one or more atomizers. Multiple atomizers of substantially the same design may be used to generate a greater quantity of mist for delivery from the deposition head, thereby increasing throughput for high-speed manufacturing. In this case, material of substantially the same composition preferably serves as feedstock for the multiple atomizers. Multiple atomizers may share a common feedstock chamber or optionally may utilize separate chambers. Separate chambers may be used to contain materials of differing composition, preventing the materials from mixing. In the case of multiple materials, the atomizers may run simultaneously, delivering the materials at a desired ratio. Any material may be used, such as an electronic material, an adhesive, a material precursor, or a biological material or biomaterial. The materials may differ in material composition, viscosity, solvent composition, suspending fluid, and many other physical, chemical, and material properties. The samples may also be miscible or non-miscible and may be reactive. In one example, materials such as a monomer and a catalyst may be kept separate until use to avoid reaction in the atomizer chamber. The materials are then preferably mixed at a specific ratio during deposition. In another example, materials with differing atomization characteristics may be atomized separately to optimize the atomization rate of the individual materials. For example, a suspension of glass particles may be atomized by one atomizer while a suspension of silver particles is atomized by a second atomizer. The ratio of glass to silver can be controlled in the final deposited trace.

The atomizers may alternatively run sequentially to deliver the materials individually, either in the same location or in differing locations. Deposition in the same location enables composite structures to be formed, whereas deposition in different areas enables multiple structures to be formed on the same layer of a substrate.

Figure 7:
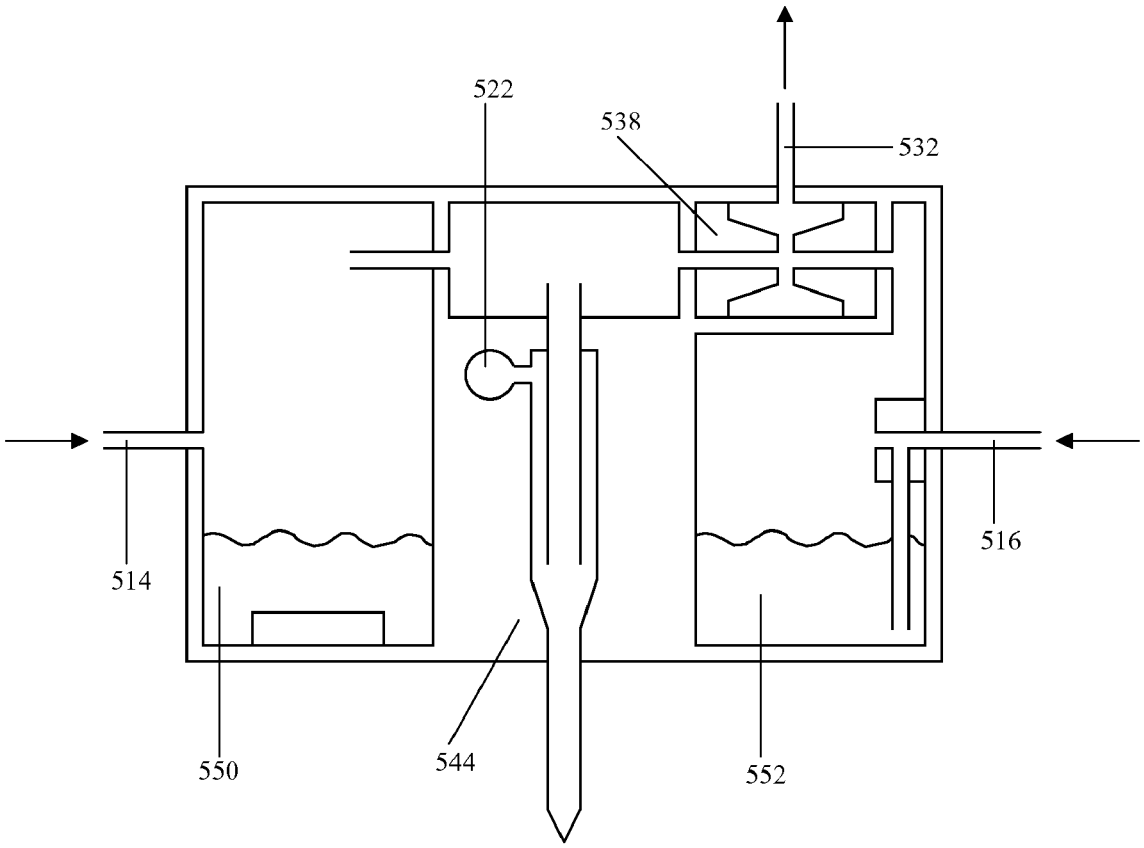
FIG. 7 is a schematic of multiple atomizers (one a pneumatic atomizer contained within one chamber and the other an ultrasonic atomizer contained within another chamber) integrated with the deposition head.

Optionally the atomizers may comprise different designs. For example, a pneumatic atomizer might be contained within one chamber and an ultrasonic atomizer might be contained in another chamber, as shown in FIG. 7. This allows the choice of atomizer to be optimized to match the atomization characteristics of the materials.

Figure 6:
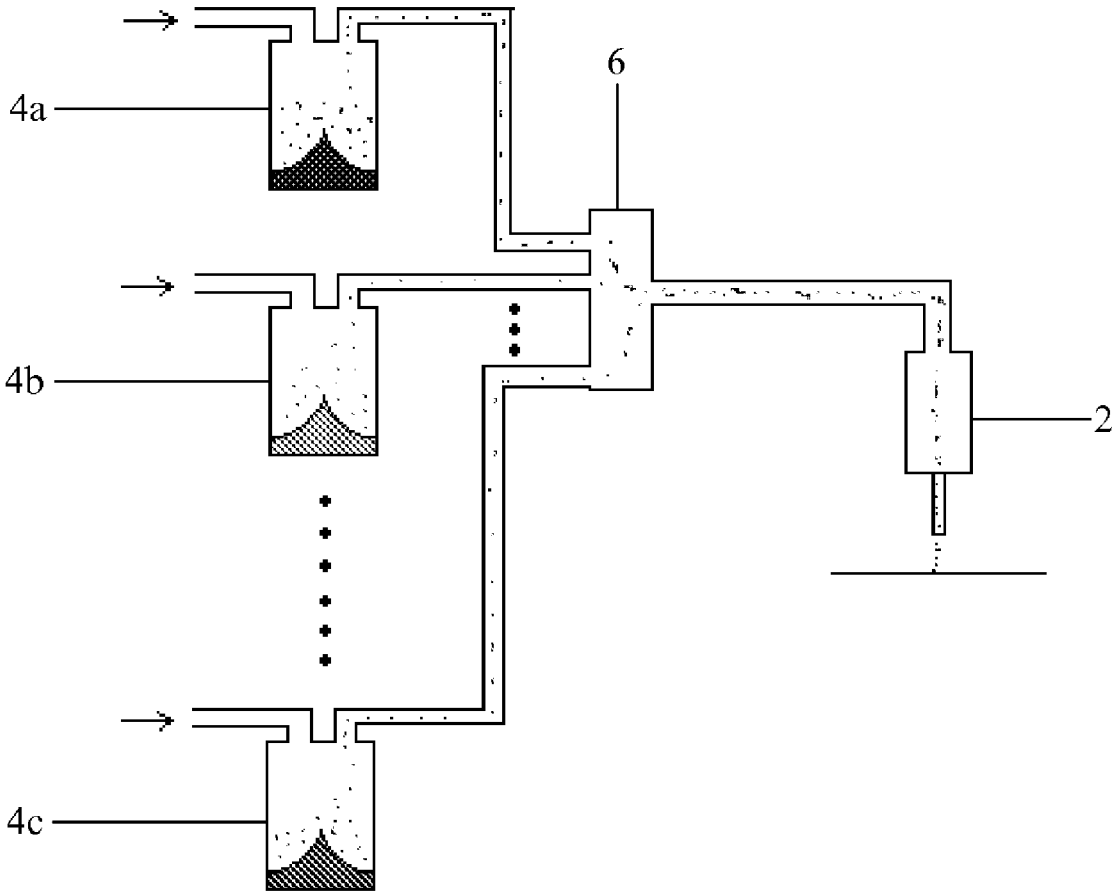
FIG. 6 is a schematic of another alternative embodiment of a multi-nozzle integrated atomizing system with a deposition head and a flow reduction device.

FIG. 6 depicts the $M^3D$® process used to simultaneously deposit multiple materials through a single deposition head. Each atomizer unit 4*a-c* creates droplets of its respective sample, and the droplets are preferably directed to combining chamber 6 by a carrier gas. The droplet streams merge in combining chamber 6 and are then directed to deposition head 2. The multiple types of sample droplets are then simultaneously deposited. The relative rates of deposition are preferably controlled by the carrier gas rate entering each atomizer 4*a-c*. The carrier gas rates can be continuously or intermittently varied.

Such gradient material fabrication allows continuum mixing ratios to be controlled by the carrier gas flow rates. This method also allows multiple atomizers and samples to be used at the same time. In addition, mixing occurs on the target and not in the sample vial or aerosol lines. This process can deposit various types of samples, including but not limited to: UV, thermosetting, or thermoplastic polymers; adhesives; solvents; etching compounds; metal inks; resistor, dielectric, and metal thick film pastes; proteins, enzymes, and other biomaterials; and oligonucleotides. Applications of gradient material fabrication include, but are not limited to: gradient optics, such as 3D grading of a refractive index; gradient fiber optics; alloy deposition; ceramic to metal junctions; blending resistor inks on-the-fly; combinatorial drug discovery; fabrication of continuum grey scale photographs; fabrication of continuum color photographs; gradient junctions for impedance matching in RF (radio frequency) circuits; chemical reactions on a target, such as selective etching of electronic features; DNA fabrication on a chip; and extending the shelf life of adhesive materials.

FIG. 7 shows the integration of multiple atomizers with the deposition head. On one side of the deposition head 544 is ultrasonic atomizer section 550 with mist air inlet 514. On the other side of deposition head 544 is pneumatic atomizer 552 with mist air inlet 516 and virtual impactor 538, with exhaust gas outlet 532. Sheath gas inlet 522 does not show the sheath gas path in the figure. While this embodiment is optimized to match the atomization characteristics of the materials, other combinations of multiple atomizers are possible, such as two or more ultrasonic atomizers; two or more pneumatic atomizers; or any combination thereof.

Non-integrated Atomizers or Components

There are situations in which it is not preferable to integrate the atomizer, or certain components, as a single unit with the deposition head. For example, the deposition head typically has the ability to print when oriented at an arbitrary angle to vertical. However, an atomizer may include a reservoir of fluid that must be maintained in a level position in order to function properly. Thus, in the case where the head is to be articulated, such an atomizer and head must not be connected rigidly, thereby enabling the atomizer to remain level during such articulation. One example of such a configuration is the case of such an atomizer and deposition head mounted onto the end of a robotic arm. In this example, the atomizer and deposition head assembly move together in x, y and z. However, the apparatus is configured such that only the deposition head is free to tilt to an arbitrary angle. Such a configuration is useful for printing in three dimensional space, such as onto the exterior, interior, or underside of structures, including but not limited to large structures such as airframes.

In another example of a closely coupled but not fully integrated atomizer and print head, the combined unit is arranged such that the deposition head can extend into a narrow passage.

While in certain configurations the mist-generating portion of the atomizer is located adjacent to the deposition head, non mist-generating portions of the atomizer may optionally be located remotely. For example, the driver circuit for an ultrasonic atomizer might be located remotely and not integrated into the apparatus. A reservoir for the material feedstock might also be remotely located. A remotely located reservoir might be used to refill the local reservoir associated with the deposition head to enable a longer period of operation without user maintenance. A remotely located reservoir can also be used to maintain the feedstock at a particular condition, for example to refrigerate a temperature-sensitive fluid until use. Other forms of maintenance may be performed remotely, such as viscosity adjustment, composition adjustment or sonication to prevent agglomeration of particulates. The feedstock may flow in only one direction, e.g. to resupply the local ink reservoir from the remotely located reservoir, or may alternatively be returned from the local ink reservoir to the remote reservoir for maintenance or storage purposes.

Materials

The present invention is able to deposit liquids, solutions, and liquid-particle suspensions. Combinations of these, such as a liquid-particle suspension that also contains one or more solutes, may also be deposited. Liquid materials are preferred, but dry material may also be deposited in the case where a liquid carrier is used to facilitate atomization but is subsequently removed through a drying step.

Reference to both ultrasonic and pneumatic atomization methods has been made herein While either of these two methods may be applicable for atomizing fluids having only a specific range of properties, the materials that may be utilized by the present invention are not restricted by these two atomization methods. In the case where one of the aforementioned atomization methods is inappropriate for a particular material, a different atomization method may be selected and incorporated into the invention. Also, practice of the present invention does not depend on a specific liquid vehicle or formulation; a wide variety of material sources may be employed.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A deposition head for depositing a material, the deposition head comprising:

one or more carrier gas inlets;

one or more atomizers;

an aerosol manifold structurally integrated with said one or more atomizers for receiving aerosol from said one or more atomizers;

one or more aerosol delivery conduits in fluid connection with said aerosol manifold;

a sheath gas inlet; and one or more material deposition outlets;

wherein receiving ends of said one or more material deposition outlets are disposed within said aerosol manifold.

2. The deposition head of claim 1 further comprising a virtual impactor and an exhaust gas outlet, said virtual impactor disposed between at least one of said one or more atomizers and said aerosol manifold.

3. The deposition head of claim 1 further comprising a reservoir of material.

4. The deposition head of claim 3 further comprising a drain for transporting unused material from the aerosol manifold back into said reservoir.

5. The deposition head of claim 3 further comprising an external reservoir of material useful for a purpose selected from the group consisting of enabling a longer period of operation without refilling, maintaining the material at a desired temperature, maintaining the material at a desired viscosity, maintaining the material at a desired composition, and preventing agglomeration of particulates.

6. The deposition head of claim 1 further comprising a sheath gas manifold concentrically surrounding at least a middle portion of said one or more aerosol delivery conduits.

7. The deposition head of claim 1 further comprising a sheath gas chamber surrounding a portion of each aerosol delivery conduit comprising a conduit outlet.

8. The deposition head of claim 7 wherein said aerosol delivery conduit is sufficiently long so a sheath gas flow is substantially parallel to an aerosol flow before said flows combine at or near an outlet of said sheath gas chamber after said aerosol flow exits said conduit outlet.

9. The deposition head of claim 1 wherein said deposition head is replaceable.

10. The deposition head of claim 9 further comprising a material reservoir prefilled with material before installation.

11. The deposition head of claim 9 wherein said deposition head is disposable or refillable.

12. The deposition head of claim 1 wherein each of said one or more atomizers atomizes different materials.

13. The deposition head of claim 12 where the different materials do not mix and/or react until just before or during deposition.

14. The deposition head of claim 12 wherein the ratio of materials to be deposited is controllable.

15. The deposition head of claim 12 wherein said atomizers are operated simultaneously or at least two of said atomizers are operated at different times.

16. An apparatus for three-dimensional material deposition, the apparatus comprising a deposition head and an atomizer, wherein said deposition head and atomizer travel together in three linear dimensions, and wherein said deposition head is tiltable but said atomizer is not tiltable; wherein said deposition head comprises a region for combining a sheath gas and an aerosol.

17. The materials deposition apparatus of claim 16 useful for depositing the material on the exterior, interior, and/or underside of a structure.

18. The materials deposition apparatus of claim 16 configured so that said deposition head is extendible into a narrow passage.

* * * * *